US005990464A

United States Patent [19]

Hino et al.

[11] Patent Number: 5,990,464

[45] Date of Patent: Nov. 23, 1999

[54] METHOD FOR PRODUCING HOT ROLLED STEEL SHEET USING INDUCTION HEATING AND APPARATUS THEREFOR

[75] Inventors: Yoshimichi Hino; Toru Minote; Sadakazu Masuda; Masaaki Yamamoto; Hisatomo Eda; Takumasa Terauchi, all of Fukuyama, Japan

[73] Assignee: NKK Corporation, Tokyo, Japan

[21] Appl. No.: 08/958,069

[22] Filed: Oct. 27, 1997

[30] Foreign Application Priority Data

Oct. 30, 1996 [JP] Japan ..... 8-288357
Oct. 31, 1996 [JP] Japan ..... 8-290010

[51] Int. Cl.[6] ..... H05B 6/06; B21B 1/26

[52] U.S. Cl. ..... 219/602; 219/645; 219/656; 219/674; 72/202

[58] Field of Search ..... 219/602, 645, 219/646, 656, 674, 671, 610; 72/202, 200

[56] References Cited

U.S. PATENT DOCUMENTS

| | | | |
|---|---|---|---|
| 3,587,268 | 6/1971 | Bricmont . | |
| 3,705,967 | 12/1972 | Bobart et al. . | |
| 4,447,690 | 5/1984 | Grever | 219/656 |
| 5,179,258 | 1/1993 | Arvedi et al. | 219/645 |

FOREIGN PATENT DOCUMENTS

| | | | |
|---|---|---|---|
| 0243340 A1 | 10/1987 | European Pat. Off. . | |
| 51-122649 | 10/1976 | Japan . | |
| 52-30936 | 3/1977 | Japan | 219/656 |
| 54-9034 | 1/1979 | Japan | 219/656 |
| 59-92114 | 5/1984 | Japan . | |
| 62-214804 | 9/1987 | Japan . | |
| 1-321009 | 12/1989 | Japan . | |
| 4-33715 | 2/1992 | Japan . | |
| 6-269840 | 9/1994 | Japan . | |
| WO 90/14742 | 11/1990 | WIPO . | |

OTHER PUBLICATIONS

Patent Abstracts of Japan, vol. 014, No. 127 (M–0947), Mar. 9, 1990 & JP 01 321009 A (Kawasaki Steel Corp.), Dec. 27, 1989.

Induction Heating in Rolling Mills, ABB Review, vol. 89, No. 2, Feb. 1989, pp. 25–30.

Ross N.V. et al: "Induction Heating of Strip: Solenoidal and Transverse Flux" Iron and Steel Engineer, vol. 69, No. 6, Jun. 1992, pp. 39–43.

*Primary Examiner*—Philip H. Leung
*Attorney, Agent, or Firm*—Frishauf, Holtz, Goodman, Langer & Chick, P.C.

[57] ABSTRACT

A method and hot rolling apparatus for producing a hot rolled steel sheet include a roughing rolling mill to roughing roll a heated slab into a sheet bar, at least one solenoid-type induction heater arranged for re-heating the sheet bar over its entire width, and a finish rolling mill arranged to finish roll the re-heated sheet bar into a hot rolled steel sheet having a predetermined thickness. An initial temperature before rolling is set to be low, and re-heating of the sheet bar is carried out around the middle of the hot rolling apparatus. The thermal energy required for rolling is thereby reduced as a whole without damaging the quality of the resulting hot rolled steel sheet. A descaling apparatus is provided prior to the finish rolling mill to remove oxide scales on surfaces of the sheet bar, whereby the resulting hot rolled steel sheet is free of scale flaws and exhibits superior surface properties.

19 Claims, 5 Drawing Sheets

METHOD FOR PRODUCING HOT ROLLED STEEL SHEET USING INDUCTION HEATING AND APPARATUS THEREFOR

BACKGROUND OF THE INVENTION

1. Field of the Invention

The present invention broadly relates to hot rolling methods and facilities for metallic sheets, and more particularly, to a method and apparatus for producing a hot rolled steel sheet.

2. Description of the Related Art

In a process of hot rolling a sheet, such as a process for hot rolling a steel sheet, the rolled sheet should be rolled at a temperature as low as possible but above a required level. In general, when the temperature is higher, more energy is lost per unit time period, and the temperature more rapidly decreases. Accordingly, in view of efficient utilization of thermal energy, hot rolling should preferably be carried out at a temperature as low as possible but still capable of securing product quality.

As described above, a decrease in the temperature of the rolled sheet during the rolling process can be a cause of some problems. In a rolling process including major steps of roughing rolling and finish rolling, the rolled sheet should be at a temperature which is higher than a predetermined level after the finish rolling step. Further, since deformation resistance should be restricted so as not to exceed limitations concerning performance of a finish rolling mill, the temperature should be controlled so as not to be lower than a predetermined level before the sheet is sent to the finish rolling mill. Hitherto, due to such requirements, an initial temperature was determined taking into account any decrease in the temperature during the roughing rolling step.

In methods disclosed in Japanese Unexamined Patent Publications No. 59-92114 and No, 62-214804, edge portions of sheets, which particularly readily grow cold, are re-heated by transverse-type induction heating.

Front and rear end portions of sheets also readily grow cold, and Japanese Unexamined Patent Publications No. 1-321009 and No. 4-3371, disclose methods in which the front and rear end portions of a sheet are heated over an entire width by an edge-heating apparatus used in the methods disclosed in Japanese Unexamined Patent Publications No. 59-92114 and No. 62-214804, while moving the apparatus in a sheet-width direction when the front and rear end portions pass over it.

As a method in which heating is performed over the entire sheet-width, Japanese Unexamined Patent Publication No. 51-122649 discloses a method in which a transverse-type induction heater is arranged, to preheat a steel sheet for a subsequent process, as close as possible to an apparatus for the subsequent process.

However, although the initial temperature can be lowered to some extent, a drastic resolution has not been achieved yet by the above-described methods, disclosed in Japanese Unexamined Patent Publications No. 59-92114, No. 62-214804, No. 1-321009, and No. 4-33715, which compensate for the temperature decrease heavily occurring in the edge portions of sheets or at the front and rear ends thereof in order that the initial temperature before rolling should be set low.

In such circumstances, a method has been considered in which a heater is intermediately arranged, the initial temperature is aggressively lowered to reduce a thermal energy loss in an early stage of rolling, and rolling is carried out while being accompanied by re-heating performed at an appropriate position.

Induction heating can be considered as an easily-practiced technique for intermediate heating. However, transverse-type induction heating which is described in Japanese Unexamined Patent Publication No. 51-122649 has some problems such as a complicated apparatus due to a necessity of providing a means for controlling a coil gap, and excessive heating of edge portions of sheets.

As described in Japanese Unexamined Patent Publication No. 51-122649, the re-heating apparatus is usually arranged as close as possible to the apparatus of the subsequent step. According to such an arrangement, however, since a surface temperature of a sheet is high, thermal energy added by induction heating is readily lost in a case where the subsequent step, such as descaling or rolling, can be a cause of cooling from the sheet surfaces.

In a process for producing a hot rolled steel sheet, since the sheet: is heated and rolled in a high temperature range from 800 to 1300° C., oxide scales are generated on surfaces of the sheet. If such scales are left on the surfaces, the scales are pressed during rolling so that they are included in the surface portion of the sheet, and the resulting hot rolled steel sheet will have scale flaws.

As is generally known, scale flaws are classified into two types described below.

(1) Inclusion Scales

Inclusion scales are generated as follows:

Scales which have not been completely removed in a descaling process preceding a finish rolling mill are pressed into the surface portion of the sheet during a finish rolling process.

(2) Particulate Scales

Particulate scales are generated as follows:

Secondary scales which have been generated after the descaling process preceding the finish rolling mill are pressed into the surface portion of the sheet during the finish rolling process.

In order to prevent the generation of inclusion scales, a surface temperature of a sheet before descaling should be set at a high value. The higher the surface temperature of the sheet is, the greater the amount of generated scales becomes and the larger the internal stress of the scales becomes, since the temperature difference between before and after the descaling process becomes large, and a thermal stress generated on interfaces between the scales and the sheet also becomes large.

Japanese Unexamined Patent Publication No. 6-269840 discloses a method in which surfaces of a sheet are heated using gas burners at a position just preceding a descaling apparatus.

On the other hand, in order to prevent the generation of particulate scales, the surface temperature of the sheet after descaling should be restricted to inhibit the generation of secondary scales.

The surface temperature of the sheet before descaling should preferably be as high as possible to prevent the generation of inclusion scales, while it should preferably be as low as possible to prevent the generation of particulate scales. Accordingly, there is an optimum temperature range in which neither type of scales are generated, and the temperature of the sheet before descaling should be controlled so that it falls within the optimum range in which neither type of scales are generated.

In a method disclosed in Japanese Unexamined Patent Publication No. 6-269840, temperature control is substantially impossible since surfaces of a sheet are heated using gas burners. Since a temperature of the sheet may be too low in some cases while it may be too high in other cases, it is difficult to prevent the generation of both types of scales.

Further, the use of gas burners is also accompanied by problems such as those described below.

(1) The productivity is lowered because a time period for preparation such as preheating is required for ignition and extinction of the gas burners.

(2) The working environment readily deteriorates due to generation of combustion gases.

SUMMARY OF THE INVENTION

Aiming to solve the above-described problems, an object of the present invention is to provide a method and hot rolling apparatus for producing a hot rolled steel sheet, in which thermal energy required for rolling can be reduced as a whole without damaging the quality of the hot rolled steel sheet.

Another object of the present invention is to provide a method and hot rolling apparatus for producing a hot rolled steel sheet having excellent surface properties without scale flaws.

In order to solve the above-described problems and to achieve the above objects, the present invention provides a method and hot rolling apparatus for producing a hot rolled steel sheet. The apparatus comprises:

(a) a roughing rolling mill to roughing-roll a heated slab into a sheet bar;

(b) at least one solenoid-type induction heater to re-heat the sheet bar; and (c) a finish rolling mill to finish-roll the re-heated sheet bar.

The apparatus further comprises an apparatus for adjusting a heating position such that a surface temperature of the sheet bar before the finish rolling mill is lower than a temperature in a thicknesswise center of the sheet bar.

According to the above method and apparatus, the thermal energy required for rolling can be reduced as a whole without damaging the quality of the hot rolled steel sheets.

The present invention provides another method and hot rolling apparatus for producing a hot rolled steel sheet, wherein the apparatus comprises:

(a) a roughing rolling mill to roughing-roll a slab having a predetermined temperature into a sheet bar;

(b) at least one solenoid-type induction heater to re-heat the sheet bar over an entire width of the sheet bar;

(c) a descaling apparatus for descaling oxide scales on surfaces of the sheet bar; and (d) a finish rolling mill to finish-roll the sheet bar, wherein the solenoid-type induction heater and the descaling apparatus are arranged between the roughing rolling mill and the finish rolling mill in an order of the roughing rolling mill, the solenoid-type induction heater, the descaling apparatus, and the finish rolling mill.

The above-described apparatus further comprises apparatus for controlling a surface temperature of the sheet bar on an inlet side of the descaling apparatus within a range of from about 1000° C. to about 1020° C.

According to the above method and apparatus, hot rolled steel sheets having excellent surface properties without scale flaws can be produced.

DETAILED DESCRIPTION

Description of the First Embodiment

Figure 1:
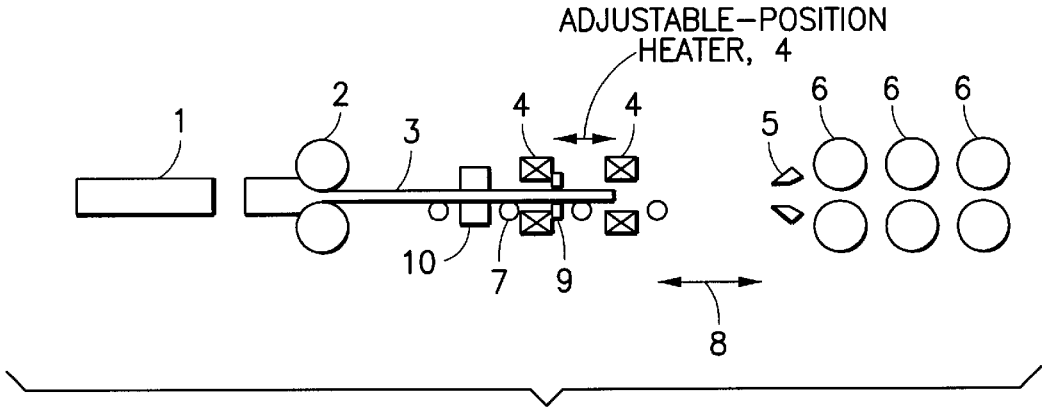
FIG. 1 shows a schematic layout of a hot rolling apparatus in accordance with a first embodiment of the present invention.

The inventors conducted investigations concerning a method and a hot rolling apparatus for producing a hot rolled steel sheet, in which an initial temperature before rolling can be set at a low value, a re-heating apparatus is arranged in the middle of the hot rolling apparatus, and thermal energy required for rolling can be reduced as a whole without damaging the quality of the hot rolled steel sheet. As a result, they have found that the following techniques are is effective for reducing the thermal energy required for rolling as a whole without damaging the quality of the hot rolled steel sheet:

employing at least one solenoid-type induction heater as the re-heating apparatus arranged in the middle of the hot rolling apparatus; and arranging and operating the heater in a manner by which a thermodiffusion time period can be set and controlled such that heat added to a sheet bar is sufficiently diffused in the thickness direction of the sheet bar and is not readily last from surfaces in a subsequent step, and such that a surface temperature of the sheet bar is lower than a temperature in the thicknesswise center of the sheet bar.

Further, the present inventors have obtained the following findings:

- the above-described thermodiffusion time period can be determined according to a relational equation based on properties and a thickness of a sheet bar;
- the decrease in temperature in edge portions can be compensated for by heating the side edge portions of the sheet bar using an edge heater arranged in the hot rolling apparatus, and a uniform quality over the sheet bar can be thereby achieved;
- defect generation due to an excessive increase in a surface temperature by heating can be prevented by arranging a leveler preceding the solenoid-type induction heater; and
- if the position of the heater is limited to a region preceding the finish rolling mill, a high heating efficiency can be achieved by setting an excitation frequency of the heater within a specific range with respect to a specific range of sheet bar thickness.

Based on the above findings, the present inventors conceived a method and hot rolling apparatus for producing a hot rolled steel sheet in which the thermal energy required for rolling can be reduced as a whole without damaging the quality of the hot rolled steel sheet, and have accomplished a preferred embodiment, wherein at least one solenoid-type induction heater is employed as the re-heating apparatus arranged in the middle of the hot rolling apparatus; the thermodiffusion time period in the thickness direction, which allows the heat added to the sheet bar to be sufficiently diffused in the thickness direction so that the heat is not readily lost from the surfaces in the subsequent step, and which achieves a surface temperature of the sheet bar lower than the temperature in the thicknesswise center of the sheet bar, is determined in accordance with the properties and the thickness of the sheet bar; and the heater is arranged and operated in accordance with the time period. The inventors developed a further preferred embodiment based on the above, in which at least one edge heater for heating the side edge portions of the sheet bar is arranged in the above hot rolling apparatus; a leveler is arranged at a position preceding the solenoid-type induction heater; and the excitation frequency of the heater is set within a range with respect to a specific thickness of the sheet bar in the case where the heater is arranged at a position preceding the finish rolling mill.

In summary, according to a preferred embodiment, the apparatus and the manufacturing conditions are specified within the ranges described below, and there are provided a method and hot rolling apparatus in which the thermal energy required for rolling can be reduced as a whole without damaging the quality of the hot rolled steel sheet.

A first preferred embodiment of the invention is described below with reference to FIG. 1. In a conventional hot rolling technique, a slab or steel ingot 1 is roughing rolled by a roughing rolling mill 2, while being maintained at a high temperature directly after solidification or by re-heating, into a sheet bar 3 having an intermediate thickness.

After this, the sheet bar is carried by table rollers 7, subjected to surface scale removal by a descaling apparatus 5 or the like, and is finish rolled by a finish rolling mill 6 into a steel sheet having a final thickness. Subsequently, an appropriate cooling step by a cooling apparatus or the like which is not shown in FIG. 1, a step of coiling the sheet into a coil, and other known steps are carried out.

According to the first embodiment, in such an apparatus, at least one solenoid-type induction heater 4 is provided as a re-heating apparatus between the roughing rolling mill 2 and the finish rolling mill 6, and the at least one heater 4 is situated such that the temporal distance 8 (thermodiffusion time period) from the end of the heating step to the descaling step or the subsequent finish rolling step is longer than a predetermined time period, the thermal energy is thereby sufficiently diffused into the inside of the sheet bar 3 in which only the surface temperature is high due to the skin effect, and thus the surface temperature becomes lower than the temperature in the thicknesswise center of the sheet.

The above is based on the following principle: In maintaining the material temperature at above a certain value by adding a certain thermal energy to a material, thermal radiation can be further restricted and the high-temperature state can be maintained for a longer time period by a procedure in which the energy is divided into two, and the divided energies are added with a temporal interval, as compared with a procedure in which the thermal energy is added once at the beginning. In order to apply this principle to hot rolling for steel sheets, the re-heating apparatus requires mechanical simplicity, ease of installation, and superior heating efficiency. From this point of view, to achieve these characteristics, at lest one solenoid-type induction heater 4 is employed.

More specifically, for a hot rolling apparatus, an electrical heating unit achieving a higher power (high electric power) is preferred in view of a limitation concerning the time period (the position) for heating, but electric-resistance-type heating cannot be employed in view of the negative influence of sparks on the surfaces of the steel sheet, and therefore the heating apparatus is limited to an induction heating apparatus. The induction heating apparatus can be classified into a solenoid type and a transverse type. The transverse type, however, exhibits irregular heating ability depending on the heated portions, is defective in uniformly heating, and requires that the positional, relationship between a coil and a bar (steel sheet) should be maintained at an optimum level. Accordingly, the solenoid type heating apparatus is employed for the induction heater in the preferred embodiment, since the power (electric power) can be applied almost uniformly in the sheet-width direction and problems caused by biased heating are reduced as compared with the transverse type heater in the case where a sheet bar with a thickness of a few tens of millimeters is heated, and the heater has a simple structure so that the sheet bar can be heated simply by passing through the heater.

Further, the thermodiffusion time period after heating is set longer than a certain time period since the surface temperature inevitability becomes high in the case of solenoid-type heating, and therefore, sufficient thermal diffusion in the sheet-thickness direction and an appropriate temperature distribution in the sheet-thickness direction are necessary for preventing easy loss of the applied heat from the surfaces in the subsequent step. In the preferred embodiment, the heater is situated and operated such that the time period from the re-heating step to the subsequent step can be adjusted and controlled.

The thermodiffusion time period is determined such that the thermal energy applied by the solenoid-type induction heater at a constant level remains sufficiently high after finish rolling.

More specifically, the thermodiffusion time period is determined such that the difference according to the subtraction of the steel central temperature from the steel surface temperature has at least a minus value, and preferably, about −10 ° C. or below.

Further, in the case where the finish rolling rate is varied, the re-heating apparatus 4 may be arranged to include a device or unit for moving the apparatus 4, such as rails in the longitudinal direction of the apparatus and on which the re-heating apparatus 4 is movably mounted, to adjust a heating position, or the time period for thermal diffusion may be adjusted in a manner in which a plurality of re-heating apparatuses 4 are arranged (see FIG. 8) and the effective heating position is adjusted by selecting at least one turned-on heating apparatus 4 out of the plurality of heating apparatuses 4.

The position of the re-heating apparatus 4 is not limited to a place between the roughing rolling mill 2 and the finish rolling mill 6, and the re-heating apparatus 4 may be situated in the middle of the roughing rolling mills.

Moreover, although the thermodiffusion time period varies depending on the properties of a sheet bar and a thickness thereof at the time of induction heating, a value of the time period suitable to properties and a thickness can be determined according to the following equation (1):

$$T=\alpha\times(\rho C_p/\lambda)\times H^2 \quad (1)$$

where:

T represents the time period for thermodiffusion, $\alpha$ represents a coefficient inherent in the hot rolling apparatus, $\rho$ represents a density of the sheet bar, $C_p$ represents the specific heat of the sheet bar, $\lambda$ represents the thermal conductivity of the sheet bar, and H represents a thickness of the sheet bar.

In summary, the thermodiffusion time period, which varies according to a change in conditions such as properties and a thickness, is determined by the above equation (1) and is set by adjusting the position of the induction heater 4, and a high heating efficiency can thereby be maintained.

In the above equation (1), the situation of thermal diffusion toward the inside of the sheet while the sheet is radiation-cooled after the completion of heating is approximately applied to the heat-transfer equation under adiabatic conditions, and the time constant for the largest attenuation value, namely, the time constant $(\rho C_p/\lambda)(H/2\pi)^2$ of the following solution of the Fourier series is used:

$$\sum_{n=0}^{n=\infty}\left(a_n\cos n\frac{2\pi}{H}x+b_n\sin n\frac{2\pi}{H}x\right)\exp\left[-\frac{1}{\frac{1}{n^2}\frac{\rho C_p}{\lambda}\left(\frac{H}{2\pi}\right)^2}t\right]$$

In the above equation, the time constant is a generic value, and the optimum thermodiffusion time periods for various sheet properties and thicknesses can be determined by determining the constant $\alpha$ in accordance with each apparatus.

Practically, $\alpha$ can be determined by determining an optimum thermodiffusion time period for a certain condition.

Furthermore, as shown in FIG. 1, an edge heater 9 to heat side edge portions of a sheet bar 3 is provided in the hot rolling apparatus of the preferred embodiment. This edge heater 9 is provided in the vicinity of the at least one solenoid-type heater 4 in order to compensate for a temperature decrease in the edge portions of the sheet bar 3, and to thereby obtain further uniform quality over the materials. The edge heater 9 can be freely positioned, and may be arranged at a position preceding a solenoid-type induction heater 4, as shown in FIG. 1.

Additionally, as shown in FIG. 1, a leveler 10 is provided at the inlet side of the heaters 4 to stably send a sheet bar toward the solenoid-type induction heater(s) 4, and preferably, the leveler 10 is arranged such that solenoid-type induction heating starts within the above-described thermodiffusion time period. An excessive increase in the surface temperature during re-heating can be prevented in such a manner, namely, by starting re-heating before thermal recovery on the sheet surface whose temperature has been reduced by the tools in the leveler 10 or the like.

When a shape of a sheet is inferior, the sheet bar cannot pass through nor be heated by the solenoid-type induction heater(s) 4 because of a gap at the opening portion thereof. In this case, the sheet bar 3 is reformed prior to being sent to the solenoid-type induction heater(s) 4. The surface temperature is, however, inevitably reduced by leveling at the leveler 10. The solenoid-type induction heater largely raises the sheet surface temperature, but a surface temperature increase during heating can be restricted by arranging the leveler 10 prior to the starting point for induction heating (as shown in FIG. 1), and preferably, within the temporal distance range 8 for the above-described thermodiffusion time period. In such a manner, the thermal energy loss by radiation during heating can be minimized, and in addition, defect generation due to an excessive increase in the surface temperature can be prevented.

Although edge portions of the sheet bar 3 are also heated, a degree of the temperature increase in those portions is the same as that in the center portion. According to the preferred embodiment, the temperature decrease in the edge portions can be completely compensated for by additionally providing an edge heater 9, as described above.

Further, when the solenoid-type induction heater 4 is arranged at a position preceding the finish rolling mill 6, the heating step is performed under the conditions that an excitation frequency of the heater is set at about 1,000 to about 3,000 Hz.

More specifically, in the hot rolling apparatus of the preferred embodiment, if the position of the induction heater 4 is limited to a region preceding the hot finish rolling mill 6 for steel, the sheet bar thickness is limited to approximately 10 to approximately 50 mm, and the properties are also limited. Accordingly, by setting the coil excitation frequency at from about 1,000 to 3,000 Hz, the effects of the preferred embodiment on the temperature distribution can be sufficiently exhibited, and a high healing efficiency can be achieved.

The heating efficiency by a solenoid-type induction heater depends on the material thickness, especially in the stage prior to hot finish rolling for steel. The surface temperature excessively increases with a frequency above about 3,000 Hz, and the induction heating efficiency is lowered with a frequency below about 1,000 Hz. Accordingly, the lower limit of the frequency is about 1,000 Hz and the upper limit of the frequency is about 3,000 Hz. The frequency may be adjusted according to the material thickness, or may be set to a typically used value.

As described above, according to the preferred embodiment, there can be provided a method and hot rolling apparatus for producing a hot rolled steel sheet, in which the thermal energy required for rolling can be reduced as a whole, without damaging the quality of the resulting rolled sheet.

EXAMPLE

An example according to a preferred embodiment of the invention is described below, referring to FIG. 1.

The effects of the preferred embodiment in a case where a sheet bar 3 with a thickness of 30 mm was finish rolled into a thickness of 25 mm by an experimental rolling mill are described below.

A descaling apparatus 5 was arranged at a position three (3) meters preceding a finish rolling mill 6, and finish rolling was carried out at a rate of 60 meters per minute. A solenoid-type induction heater 4 is arranged at a position preceding the (descaling apparatus 5, and the thermodiffusion time period 8 was varied by altering the position of the heater 4.

As a conventional way, an induction heater 4 was is arranged very close to the descaling apparatus 5, i.e, at a position one (1) meter preceding the descaling apparatus 5, and in this case, the time period from the end of heating to descaling was 1 second (conventional example). The following conditions were used in the preferred embodiment: the applied energy was constant, and the induction heater 4 was distantly placed at positions requiring 4 sec. and 9 sec., respectively, for the sheet bar to travel from the induction heater 4 to the descaling apparatus.

Figure 2:
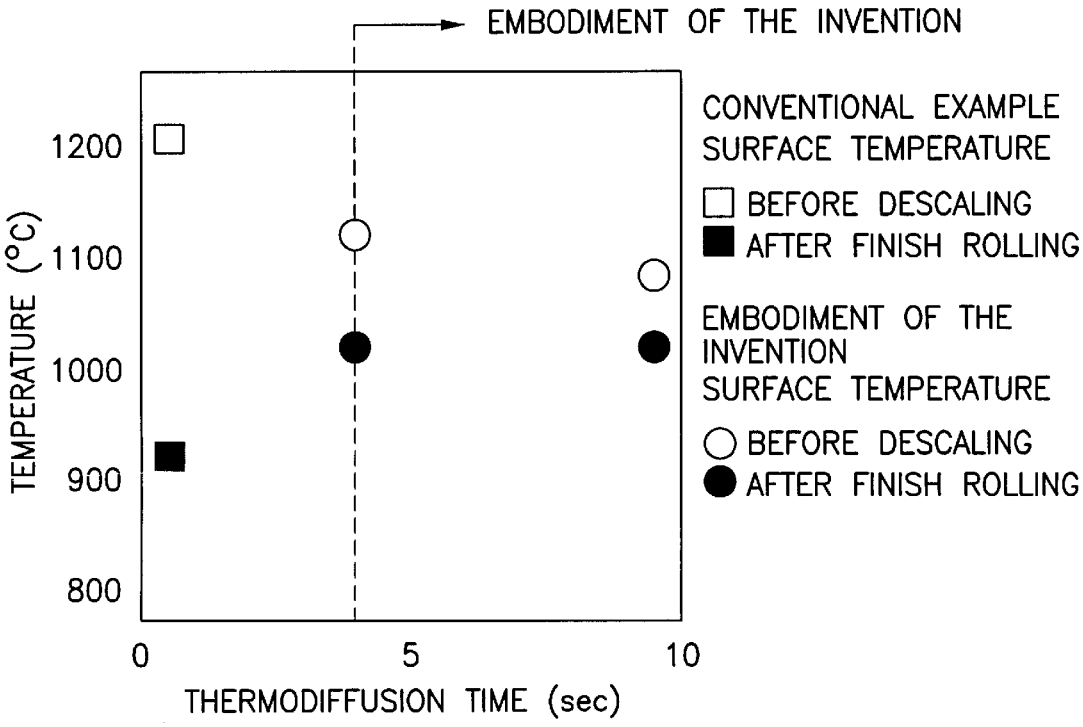
FIG. 2 shows the relationship between a thermodiffusion time period and a sheet bar surface temperature just before descaling or just after finish rolling.

As shown in FIG. 2, the surface temperature of the sheet bar just previous to the descaling apparatus 5 was high in the conventional example in which the thermodiffusion time period 8 was short.

In each case according to the preferred embodiment of the invention, where the thermodiffusion time period was set at 4 sec. or longer, the surface temperature became higher than that of the conventional example when finish rolling was completed, although the surface temperature just previous to the descaling apparatus 5 was lower. Therefore, the thermal energy loss during descaling and finish rolling was found to be lowered in the present invention.

Figure 3:
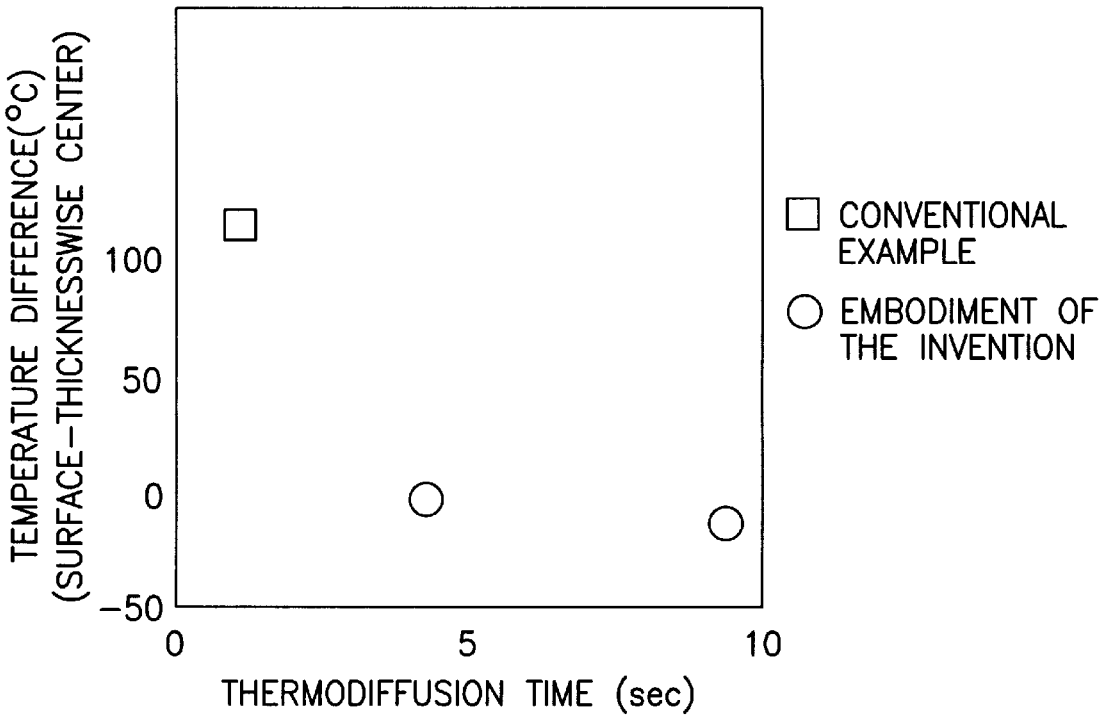
FIG. 3 shows the relationship between the thermodiffusion time period and a difference between the sheet bar surface temperature and the thicknesswise center temperature.

For a further study concerning the conditions to achieve the object of the preferred embodiment of the invention, the temperature difference between the surface and the thicknesswise center of each sheet bar was measured in the cases of the thermodiffusion time periods shown in FIG. 2. As a result, the temperature after finish rolling can be higher than that of the conventional example when, as shown in FIG. 3, the surface temperature is lower than the temperature at the thicknesswise center of the sheet bar 3.

Further, rolling processes with various steel materials and various thicknesses as shown in Table 1 (hereinbelow) were carried out to seek an appropriate thermodiffusion time period (which satisfies a preferred requirement that the sheet bar 3 has a surface temperature about 10° C. lower than the thicknesswise center temperature), and to determine $\alpha$ (a coefficient inherent in the hot rolling apparatus). As a result, this value was found to be constant.

Figure 4:
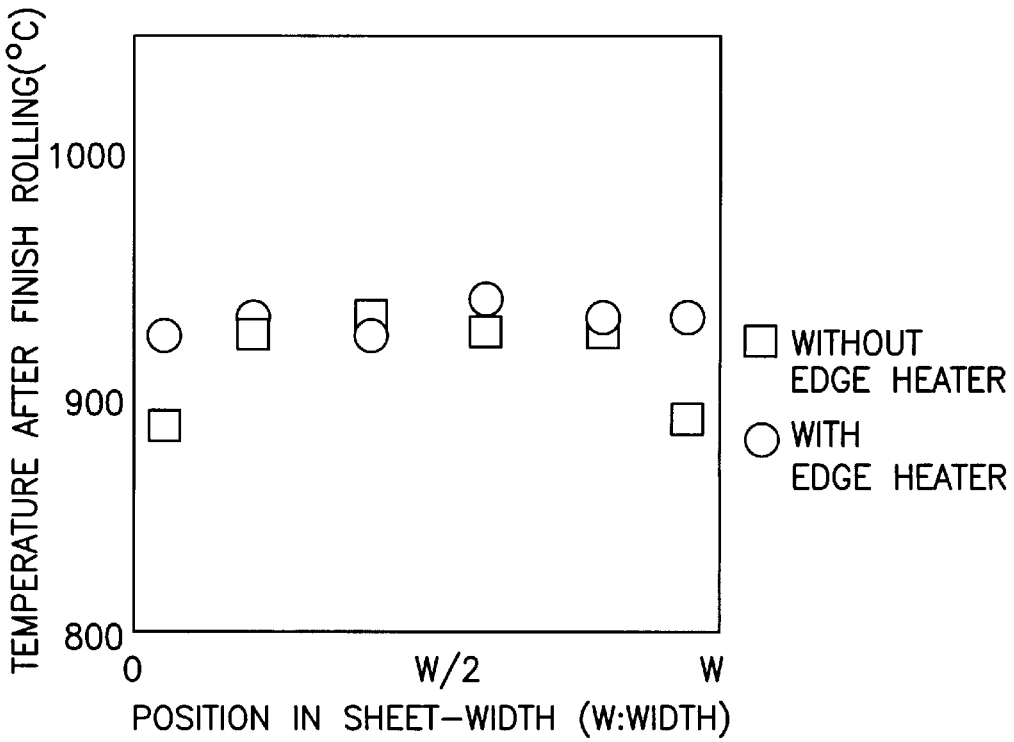
FIG. 4 shows temperature distributions in the sheet-width direction after finish rolling with and without an edge heater, in accordance with the first embodiment of the present invention.

In order to evaluate the effect of an edge heater, the temperature distribution in the sheet-width direction after finish rolling was measured. The results are shown in FIG. 4.

By arranging an edge heater 9 as shown in FIG. 1, a temperature distribution which is uniform in the sheet-width direction could be obtained, and a product having properties which are uniform in the sheet-width direction could be achieved. Due to this, it: was not necessary to set the initial temperature or the re-heating temperature high for securing the desired temperature of the side edge portions.

Figure 6:
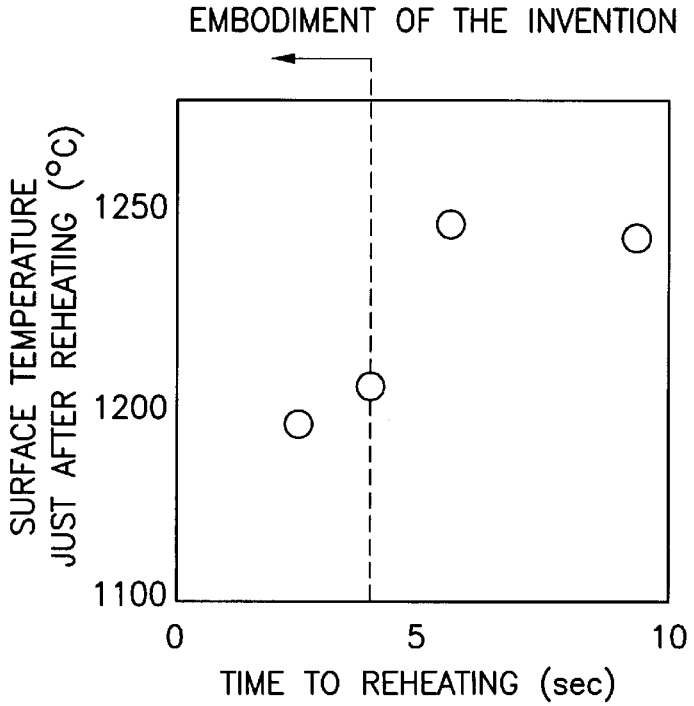
FIG. 6 shows the relationship between a time period from a completion of leveling to re-heating and the sheet bar surface temperature after re-heating.

In the example according to the preferred embodiment, a 3-roller-type leveler 10 was arranged at a position preceding the experimental induction heater 4. The position of the leveler 10 was then altered to change the time period from the end of leveling to the start of re-heating, and the surface temperature of the sheet bar 3 just after re-heating was measured using a radiation thermometer. As is obvious from the results shown in FIG. 6, if the time period from the end of leveling to the start of re-heating is set within a range of the thermodiffusion time period according to the preferred embodiment, the surface temperature can be restricted. When the time period exceeds the desired range for the time period from leveling to re-heating according to the preferred embodiment shown in FIG. 6, the surface temperature becomes higher. In this example, the surface temperature reached 1,250° C., the quality of the sheet surface deteriorated, and the amount of heat radiated from the surfaces increased.

Figure 5:
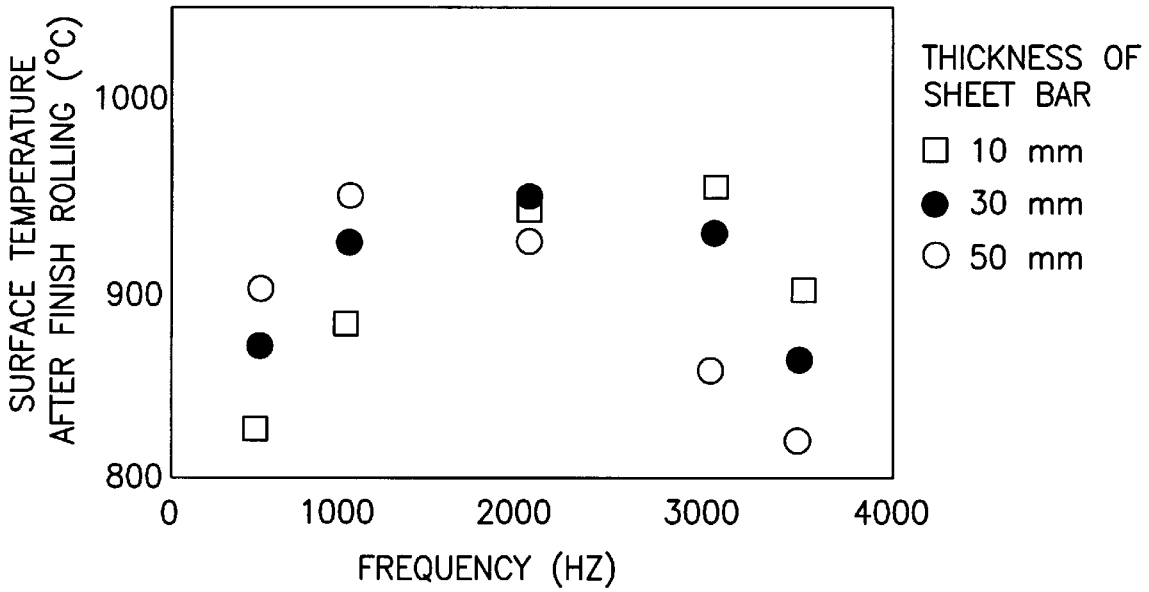
FIG. 5 shows the relationship between a frequency of a solenoid-type induction heater and the sheet bar surface temperature after finish rolling in accordance with the first embodiment of the present invention.

FIG. 5 shows the relationship between the excitation frequency of the solenoid-type heater(s) 4 and the sheet-surface temperature after finish rolling observed in the case where a constant induction-heating electric power was applied to the heaters(s) 4 of the hot rolling apparatus of. the preferred embodiment.

In view of the thickness before finish rolling, the heating ability for a sheet bar 3 having a thickness of 10 mm was extremely low when the frequency was below about 1,000 Hz, and the beating ability for a sheet bar having a thickness of 50 mm was lowered when the frequency was above about 3,000 Hz.

As described above, even in an arrangement of the apparatus according to the preferred embodiment, there exists a frequency range for effectively utilizing the applied electric power to the solenoid-type heater(s) 4 to secure the desired temperature for finish rolling, which is from about 1,000 to about 3,000 Hz.

TABLE 1

| Steel Type | Thickness at Heating (mm) | Thickness after Finish Rolling (mm) | $\alpha$ |
|---|---|---|---|
| Low Carbon Steel | 30 | 26 | 0.040 |
| Low Carbon Steel | 50 | 43 | 0.038 |
| Low Carbon Steel | 10 | 7 | 0.043 |
| SUS304 | 30 | 27 | 0.041 |
| SUS410 | 30 | 27 | 0.042 |

According to the preferred embodiment, at least one solenoid-type induction heater 4 as a re-heating apparatus is arranged around the middle of a plurality of rolling mills, and the apparatuses are arranged such that a time period for diffusion of an added heat to the inside of a sheet bar can be secured, or the apparatuses are set up so as to be operated in accordance with the required conditions. In this manner, a temperature for heating a slab in a furnace prior to rolling can be set low, quality can be secured, loads upon a finish rolling mill can be reduced, thermal energy loss during roughing rolling can be restricted, and thermal energy added by re-heating can be efficiently utilized.

Description of the Second Embodiment

Figure 7:
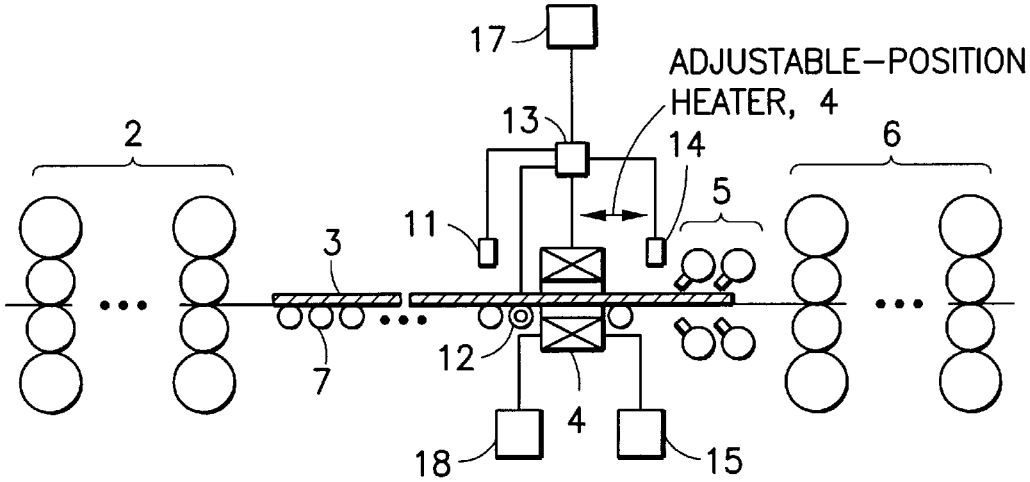
FIG. 7 shows a schematic layout of a hot rolling apparatus in accordance with a second embodiment of the present invention.

FIG. 7 shows another preferred embodiment of a hot rolling apparatus according to the present invention.

A slab heated in a furnace or produced by continuous casting and having a predetermined temperature is rough rolled by a roughing rolling mill 2 into a sheet bar 3. While being sent to a finish rolling mill 6 by table rollers 7 and when passing through an adjustable-position solenoid-type induction heater 4, the sheet bar 3 is induction-heated over its entire width, and high pressure water is then jetted from a descaling apparatus 5 onto surfaces of the sheet bar 3 to remove scales. After this, the sheet bar 3 is finish rolled by a finish rolling mill 6 to result in a hot rolled steel sheet having a predetermined thickness.

Further in FIG. 7, a thermometer 11 is provided on the inlet side of the heater 4, and a table roller 12 is provided at the inlet side of the heater 4 to detect a conveying speed. A thermometer 14 is provided on the inlet side of the descaling apparatus 5, and a controller 13 is provided to control the heater 4 based on the detected temperature of the sheet bar 3 and the detected conveying speed. As shown in FIG. 7 (and also in FIG. 8), a moving means 15 is provided for moving or changing a heating position of the solenoid-type induction heater 4. The moving means 15 may take the form of longitudinal rails extending in the longitudinal direction of the overall apparatus, and on which the solenoid-type induction heater or heaters 4 are mounted so as to be movable along the rails, as described hereinabove with respect to FIG. 1. The moving means 15 is only schematically shown in FIG. 7 for illustrative purposes.

The controller 13 shown in FIG. 7 can also adjust the time period of heating, for example, by adjusting the time period that the heater 4 is turned on. The controller 13 can also adjust the excitation frequency of the solenoid-type induction heater, or a separate means 18 can be provided for adjusting the excitation frequency of the solenoid heater.

Figure 8:
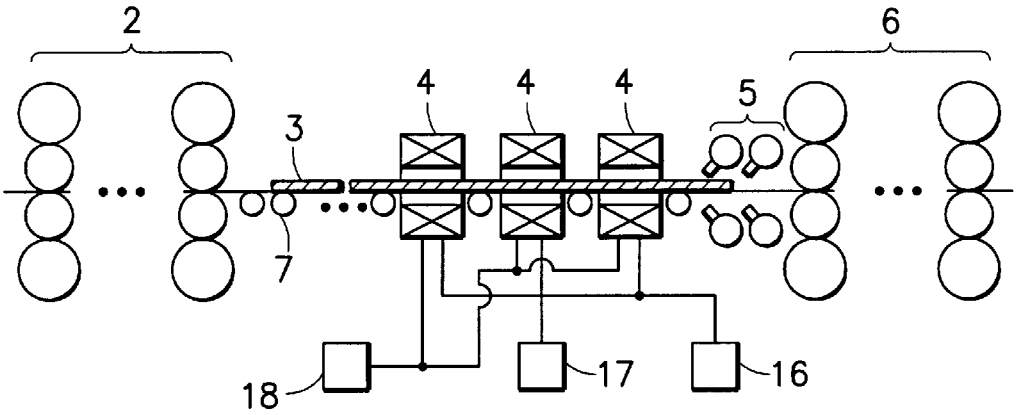
FIG. 8 shows a schematic layout of a hot rolling apparatus in accordance with another embodiment of the present invention.

In the embodiment of FIG. 8, the heating position is effectively changed by selecting one or more of the solenoid-type heating units 4 for heating the sheet bar. The selection of one or more of the solenoid-type heating units 4 is accomplished by means of a selecting unit 16, which can be in the form of a switch device, or which can also include additional control circuits for the heating units 4. As shown in FIG. 8, a control unit 17 can be provided, which is connected to each of the heating units 4, to adjust a time period for turning on the respective heating units 4. A control unit 18 can also be provided, as shown in FIG. 8, to adjust the excitation frequency of the respective heating units 4.

Although not shown in FIG. 8, each of the heating units 4 could also be adjustably mounted on, for example, elongated rails (not shown) extending along the length of the apparatus, so that the physical position of the respective heating units 4 can be varied along the rails, as in FIGS. 1 and 7.

First, a method for further securely carrying out descaling, which is directed to the prevention of inclusion-scale generation, is now described.

Scales on the surface of the sheet bar are removed by the following three forces:

(1) The impact force from high pressure water jetted by the descaling apparatus 5 onto the surfaces of the sheet bar 3.

(2) The thermal stress which is derived from the difference in the coefficient of thermal expansion between steel and scales, and which is generated by the temperature decrease on the surface of the sheet bar due to the water stream.

(3) The internal stress which is generated since scale generation is accompanied by volume expansion.

In order to further securely remove scales, the above three forces should preferably be enlarged.

Among them, the impact force can be enlarged by increasing the water pressure or flow rate, or by arranging the nozzles of the descaling apparatus 5 closer to a sheet bar 3. Increasing the water pressure or flow rate, however, requires increasing the pressure and the volume capacity of the pump of the descaling apparatus 5. As to the descaling apparatus 5, it is difficult to achieve water pressure or flow rate levels higher than the existing levels in view of the problems concerning costs, the space for installation, or destabilization of the water stream.

As for a method of arranging the nozzles of the descaling apparatus 5 closer to a sheet bar 3, when deformation of the sheet bar 3 such as upward warping occurs, the sheet bar 3 may meet with (i.e., contact) the descaling apparatus to crash or otherwise damage the descaling apparatus 5. For fear of this, excessive reduction of the distance between the nozzle (s) of the descaling apparatus 5 and the sheet bar 3 is regarded as risky.

From the above-described viewpoints, in the hot rolling apparatus according to the preferred embodiment of FIG. 7, the scale-exfoliation properties of the sheet bar 3 are improved by enlarging the thermal stress and the internal stress.

The sheet bar 3 is heated over its entire width by the solenoid-type induction heater 4, and is then subjected to scale removal by jetting water streams from the descaling apparatus 5.

Figure 9:
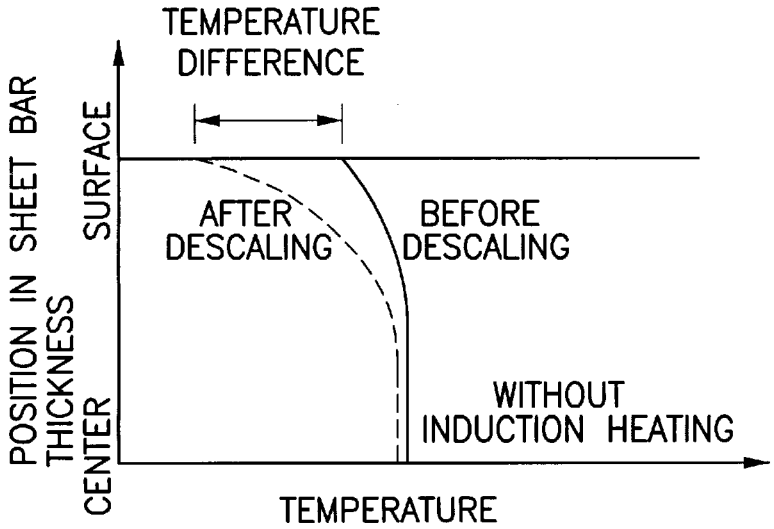
FIG. 9 shows the temperature distributions in the thickness direction of the sheet bar before and after descaling in the case without induction heating.
Figure 10:
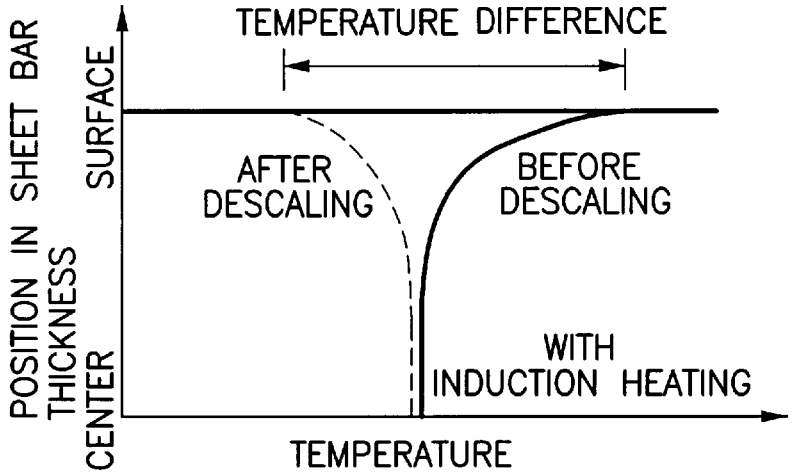
FIG. 10 shows the temperature distributions in the thickness direction of the sheet bar before and after descaling in the case where the sheet bar was heated by a solenoid-type induction heater, in accordance with the second embodiment of the present invention.

FIGS. 9 and 10 show the results of comparison on the temperature distributions in the thickness direction of the sheet bar 3 before and after descaling. FIG. 9 shows the results of the case where induction heating before descaling was not performed, while FIG., 10 shows the results in the case where induction heating before descaling was performed. The solid line in FIGS. 9 and 10 represents the temperature distribution before descaling, and the broken line represents the temperature after descaling.

By induction-heating the sheet bar 3 just before descaling, the temperature difference between before and after descaling becomes large, the thermal stress derived from the difference in the coefficients of thermal expansion between the steel and scales also becomes large, and therefore, the scale-exfoliation properties are improved.

According to the preferred embodiment of FIG. 7, the internal stress of scales can also be enlarged. The higher the temperature is, the more the amount of generated scales increases. Since scales exhibit a volume expansion of approximately 1.4 times that of steel, the internal stress of scales becomes large in proportion to the amount of generated scales, and the stress generated on the interface between scales and steel also becomes large. As a result, the removal of scales becomes easy.

In the preferred embodiment of FIG. 7, a sheet bar 3 is heated just before descaling, and the amount of generated scales is thereby increased, to securely perform the removal of scales.

It is also effective to arrange a plurality of solenoid-type induction heaters 4 to repeat heating and radiation-cooling of the sheet bar 3 before descaling. FIG. 8 shows such a hot rolling apparatus in which three solenoid-type induction heaters 4 are arranged prior to the descaling apparatus 5.

The temperature of the sheet bar 3 is raised by induction heating, and the temperature is lowered due to radiation in the time period from passing out of a solenoid-type induction heater 4 to passing into the succeeding solenoid-type induction heater 4. During these time periods, fine cracks are generated in the scales due to the thermal stress generated on the interface between the scales and the sheet bar 3. These cracks increase the rate of oxygen diffusion into the scales during the subsequent induction-heating period and make the growing rate of the scales fast, and the internal stress of the scales thereby becomes large.

Next, prevention of particulate-scale generation is described.

The cause of particulate-scale generation is secondary scales generated after descaling. In order to restrict the generation of secondary scales, the temperature after descaling is lowered. Particulate scales are readily generated if the temperature just before the descaling apparatus 5, detected by the thermometer 14 on the inlet side of the descaling apparatus 5, exceeds about 1020° C. To prevent the particulate-scale generation, the surface temperature of the sheet bar 3 on the inlet side of the descaling apparatus 5 is set at about 1020° C. or lower.

Since the surface temperature of a sheet bar 3 before descaling should preferably be as high as possible in order to prevent inclusion-scale generation, prevention of both particulate-scale generation and inclusion-scale generation can be achieved if the solenoid-type induction heater 4 is controlled such that the surface temperature of the sheet bar 3 detected by the thermometer 14 on the inlet side of the descaling apparatus 5 falls within the range of from about 1000 to about 1020° C.

Although gas burners, electric resistance heaters, and induction heaters can be considered for heating a sheet bar, solenoid-type induction heaters 4 should be employed for the following reasons:

Although a method using gas burners is proposed in Japanese Unexamined Patent Publication No. 6-269840, such a method is accompanied by problems such as, those described above in the section entitled Description of the Related Art, and is not capable of coping with the difficulties encountered in practical use. In particular, the surface temperature of the sheet bar 3 detected by the thermometer 14 on the inlet side of the descaling apparatus 5 is controlled within a narrow range of from about 1000 to about 1020° C. in order to prevent both particulate-scale generation and inclusion-scale generation. However, such precise temperature control is not possible in the case of using gas burners.

According to an electric-resistance type heating method in which electrodes are placed in contact with a sheet bar 3 and an electric current is made to flow therethrough, sparks are generated between the electrodes and the sheet bar 3, and the surface of the sheet bar 3 may thereby be damaged. Further, since the electrodes of an electric-resistance type heater wear severely, they must be changed frequently. Additionally, inferiority in a controlling response is also a problem.

In contrast, an induction heater exhibits a superior controlling response, and the surface temperature of a sheet bar 3 can be varied at will within the range of the heating capacity. Since the sheet: bar 3 can be heated without any contact, the surfaces of the sheet bar 3 are free from the possibility of being damaged. Further, as compared with other methods, induction heating has other marked advantages that it does not cause deterioration of the working environment and has the property of ease of maintenance.

Induction heating can be performed in two types of modes, i.e., a transverse type in which magnetic flux is generated in parallel to the thickness direction of the sheet bar 3, and a solenoid type in which the magnetic flux is generated in parallel to the longitudinal direction of the sheet bar 3.

Figure 11:
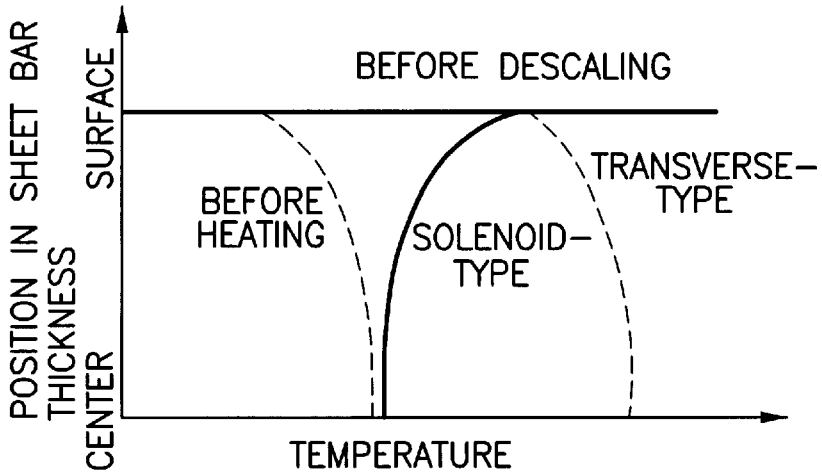
FIG. 11 shows the temperature distributions in the thickness direction of sheet bars before and after induction heating with the solenoid-type induction heater and with a transverse-type induction heater.

FIG. 11 shows the temperature distributions in the thickness direction of sheet bars just after heating by a transverse-type induction heater and just after heating by a solenoid-type induction heater, respectively.

In the transverse type, since eddy current density is substantially uniform in the thickness direction, the temperature distribution after induction heating reflects the temperature distribution before induction heating, namely, the temperature becomes lowest on the surface of the sheet bar and highest at the thicknesswise center. In the solenoid type, due to the skin effect, the eddy current density becomes highest in the surfaceportion of the sheet bar 3 and lowest at the thicknesswise center. As a result, in the temperature distribution after induction heating, the highest temperature appears on the surface of the sheet bar 3 and the lowest temperature appears at the thicknesswise center.

As is obvious from FIG. 11, the electric power necessary to obtain the same surface temperature is smaller when using the solenoid type induction heater.

Figure 12:
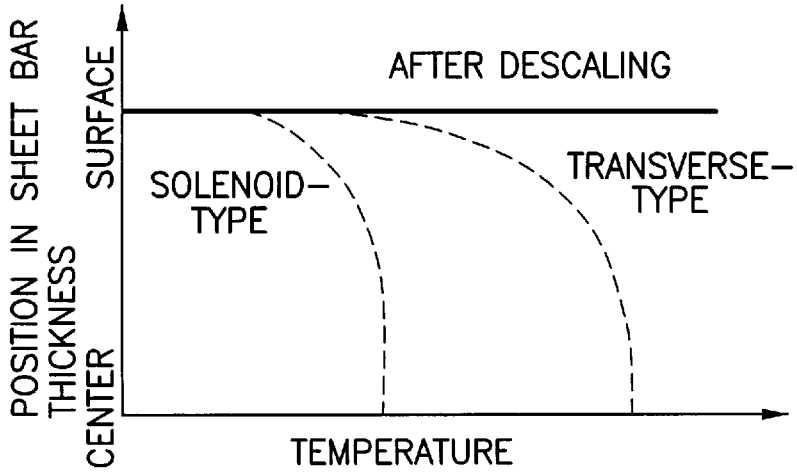
FIG. 12 shows the temperature distributions in the thickness direction of sheet bars just after descaling subsequent to induction heating with the solenoid-type induction heater and with the transverse-type induction heater.

FIG. 12 shows the temperature distributions in the thickness direction of sheet bars just after descaling which was performed after induction heating. As shown in FIG. 11, the temperature at the thicknesswise center of a sheet bar 3 before descaling is higher in the transverse type than in the solenoid type. Accordingly, the temperature at the thickness center of the sheet bar 3 after descaling is also higher in the transverse type, even if the surface temperature just after descaling is the same, the degree of increase in the surface temperature of a sheet bar 3 is higher in the transverse type due to subsequent thermal recovery from the thickness-central portion.

In order to prevent particulate-scale generation, the surface temperature of a sheet bar 3 after descaling is set at a lower value. In view of this requirement, the solenoid type induction heater is also regarded as advantageous.

From the above, it is concluded that the solenoid-type induction heater is most excellent as a heating apparatus and is preferred in the present invention.

Further, when a material subjected to heating has a size similar to that of a sheet bar 3, the frequency of the solenoid-type induction heater 4 is preferably set at from about 1000 Hz or more to sufficiently utilize the skin effect.

Since the solenoid-type induction heater 4 may get wet by water streams from the descaling apparatus 5, the solenoid-type induction heater 4 may have a waterproof structure. More specifically, for example, the solenoid-type induction heater 4 may be placed in a case which does not have openings other than the openings for receiving and sending a sheet bar 3 therethrough, and clean air may be fed by an air-blowing fan from a duct connected with the case to maintain the pressure inside the case at a positive pressure value (as described in Japanese Unexamined Patent Publication No. 6-330158).

In the preferred embodiment of FIG. 7, since the surface temperature of a sheet bar 3 at the inlet side of the descaling apparatus 5 is precisely controlled, there are provided a thermometer 11 on the inlet side of the heater 4, a thermometer 14 on the inlet side of the descaling apparatus 5, a table roller 7 for detection of conveying speed, and a controller 13 for controlling the solenoid-type induction heater 4 based on the surface temperature of the sheet bar 3 and the conveying speed which are detected by the aforementioned detecting devices.

For controlling the heater 4, the surface temperature of the sheet bar 3 detected by the thermometer 11 on the inlet side of the heater 4 may be sent to the controller 13 in a feed-forward manner, and/or the surface temperature of the sheet bar detected by the thermometer 14 on the inlet side of the descaling apparatus 5 may be sent to controller 13 in a feed-back manner.

The conveying speed of a sheet bar 3 which is calculated from the rotating speed of the table roller 7 for detection of a conveying speed is applied to the following equation to calculate the output P of the solenoid-type induction heater 4 from the necessary temperature increase ΔT:

$$P=C\cdot W\cdot H\cdot V\cdot \Delta T$$

where:

W represents the width of the sheet bar,

H represents the thickness of the sheet bar,

V represents the conveying speed of the sheet bar, and

C represents a constant determined on the basis of the specific heat and the specific gravity of the sheet bar and the efficiency of the solenoid-type induction heater.

EXAMPLE

An example according to the preferred embodiment of FIG. 7 is described below.

The effects according to the preferred embodiment of FIG. 7 are described in detail with reference to examples.

Using a hot rolling apparatus according to the preferred embodiment of Fig. 7, a sheet bar 3 having a thickness of 30 mm was finish rolled into a hot rolled steel sheet having a thickness of 1.4 mm. The steel was of a low-carbon type. Table 2 (below) shows the relationship between the surface property of the hot rolled steel sheet and the surface temperature in the widthwise central portion of the sheet bar 3 measured by the thermometer 14 on the inlet side of the descaling apparatus 5.

TABLE 2

| Temperature on Inlet Side of Descaling Apparatus | Surface Property of Hot rolled Steel Sheet |
|---|---|
| 1050 | Having Particulate Scales |
| 1030 | Having Particulate Scales |
| 1020 | Satisfactory |
| 1010 | Satisfactory |
| 1000 | Satisfactory |
| 990 | Having Inclusion Scales |
| 960 | Having Inclusion Scales |

Particulate scales were generated on the hot rolled steel sheets in the cases where the temperatures measured on the inlet side of the descaling apparatus 5 were respectively 1030 and 1050° C., and inclusion scales were generated on the hot rolled steel sheets in the cases where at the inlet side of the descaling apparatus 5 the temperatures were respectively 960 and 990° C. As is obvious from Table 2, both inclusion-scale generation and particulate-scale generation can be prevented when the temperature on the outlet side of the heater 4 (inlet side of descaling apparatus 5 ) is within 1000 to 1020° C.

In a similar manner, a sheet bar 3 having a thickness of 30 mm was finish rolled into a hot rolled steel sheet having a thickness of 1.4 mm. Table 3 (below) shows the relationship between the surface temperature of the sheet bar measured on the inlet side of the heater 4 and the surface temperature of the sheet bar 3 measured on the inlet side of the descaling apparatus 5.

TABLE 3

| Temperature on Inlet Side of Heater 4 | Temperature on Inlet Side of Descaling Apparatus 5 |
|---|---|
| 1000 | 1010 |
| 950 | 1010 |
| 900 | 1010 |

The solenoid-type induction heater of the present invention exhibited a superior controlling response, and achieved a temperature of 1010° C. on the inlet side of the descaling apparatus 5 when the temperature on the inlet side of the heater 4 ranged from 900 to 1000° C. Neither inclusion scales nor particulate scales were observed in the hot rolled steel sheets in the cases shown in Table 3.

According to the preferred embodiment of FIG. 7, descaling before finish rolling can securely be carried out, and there can be produced a hot rolled steel sheet which does not have scale flaws and which exhibits a satisfactory surface property.

The present examples and embodiments are to be considered as illustrative and not restrictive and the invention is not to be limited to the details given herein, but may be modified in various forms, such as, for example, combining features of the various embodiments, within the scope of the appended claims.

What is claimed is:

1. A method for producing a hot rolled steel sheet comprising:

(a) roughing rolling a heated slab into a sheet bar;

(b) re-heating the sheet bar by induction heating with at least one solenoid-type induction heater such that a surface temperature of the sheet bar is lower than a temperature at a thicknesswise center of the sheet bar; and (c) finish rolling the re-heated sheet bar.

2. The method according to claim 1, wherein in step (b), the temperature of the thicknesswise center of the sheet bar is 10° C. or lower than the surface temperature of the sheet bar.

3. The method according to claim 1, wherein the re-heating step further comprises:

adjusting a heating position by moving a position of the solenoid-type induction heater relative to at least one of a roughing rolling mill and a finish rolling mill.

4. The method according to claim 1, wherein the at least one solenoid-type induction heater comprises a plurality of solenoid-type induction heaters arranged between a roughing rolling mill and a finishing rolling mill, and wherein the step of re-heating further comprises:

adjusting the heating position by selecting at least one of said plurality of solenoid-type induction heaters for heating said sheet bar.

5. The method according to claims 1, further comprising the step of:

adjusting a time period for thermodiffusion in a thickness direction of the sheet bar in accordance with the following equation:

$$T=\alpha\times(\rho C_p/\lambda)\times H^2$$

where:

T represents the time period for thermodiffusion;

$\alpha$ represents a coefficient inherent in a hot rolling apparatus;

$\rho$ represents a density of the sheet bar;

$C_p$ represents the specific heat of the sheet bar;

$\lambda$ represents the thermal conductivity of the sheet bar; and

H represents a thickness of the sheet bar.

6. The method according to claim 1, further comprising the step of:

heating side edge portions of the sheet bar by at least one edge heater disposed between the roughing rolling and the finish rolling step.

7. The method according to claim 1, further comprising the step of:

leveling the sheet bar prior to the re-heating step.

8. The method according to claim 1, further comprising the step of:

setting an excitation frequency of the at least one solenoid-type induction heater between about 1,000 Hz to about 3,000 Hz, and wherein the at least one solenoid-type induction heater is arranged on an inlet side of a finish rolling mill which performs the finish rolling step.

9. A hot rolling apparatus for producing a hot rolled steel sheet, comprising:

a roughing rolling mill arranged to roughing-roll a heated slab into a sheet bar;

at least one solenoid-type induction heater arranged to re-heat the sheet bar;

means for adjusting a heating position of the sheet bar such that a surface temperature of the sheet bar before the finish rolling mill is lower than a temperature in a thicknesswise center of the sheet bar; and a finish rolling mill arranged to finish-roll the re-heated sheet bar.

10. The hot rolling apparatus according to claim 9, further comprising:

means for moving the at least one solenoid-type induction heater to adjust the heating position.

11. The hot rolling apparatus according to claim 9, wherein:

the at least one solenoid-type induction heater includes a plurality of solenoid-type induction heaters arranged between the roughing rolling mill and the finish rolling mill;

and further comprising:

means for selecting at least one of said plurality of solenoid-type induction heaters to heat the sheet bar, to thereby adjust the heating position.

12. The hot rolling apparatus according to claim 9, further comprising:

means for adjusting a time period for thermodiffusion in a thickness direction of the sheet bar in accordance with the following equation:

$$T=\alpha\times(\rho C_p/\lambda)\times H^2$$

where:

T represents the time period for thermodiffusion;

$\alpha$ represents a coefficient inherent in a hot rolling apparatus;

$\rho$ represents a density of the sheet bar;

$C_p$ represents the specific heat of the sheet bar;

$\lambda$ represents the thermal conductivity of the sheet bar; and

H represents a thickness of the sheet bar.

13. The hot rolling apparatus according to claim 9, further comprising:

at least one edge heater arranged between the roughing rolling mill and the finish rolling mill to heat side edge portions of the sheet bar.

14. The hot rolling apparatus according to claim 9, further comprising:

a leveler arranged on an inlet side of the at least one solenoid-type induction heater to level the sheet bar prior to said re-heating of the sheet bar.

15. The hot rolling apparatus according to claim 9, further comprising:

means for setting an excitation frequency of the at least one solenoid-type induction heater between about 1,000 Hz to about 3,000 Hz, the at least one solenoid-type induction heater being arranged on an inlet side of the finish rolling mill.

16. A hot rolling apparatus for producing a hot rolled steel sheet, comprising:

a roughing rolling mill to roughing-roll a slab having a predetermined temperature into a sheet bar;

at least one solenoid-type induction heater arranged to re-heat the sheet bar over an entire width of the sheet bar;

a descaling apparatus arranged for descaling oxide scales on surfaces of the re-heated sheet bar; and a finish rolling mill arranged to finish-roll the sheet bar, wherein the at least one solenoid-type induction heater and the descaling apparatus are arranged between the roughing rolling mill and the finish rolling mill in an order of the roughing rolling mill, the at least one solenoid-type induction heater, the descaling apparatus, and the finish rolling mill.

17. A hot rolling apparatus according to claim 16, further comprising:

means for controlling a surface temperature of the sheet bar on an inlet side of the descaling apparatus within a range from about 1000° C. to about 1020° C.

18. A method for producing a hot rolled steel sheet comprising:

roughing rolling a slab of a predetermined temperature into a sheet bar;

re-heating the sheet bar over an entire width of the sheet bar by at least one solenoid-type induction heater;

descaling oxide scales on surfaces of the sheet bar using a descaling apparatus;

wherein the re-heating step includes: controlling a surface temperature of the sheet bar on an inlet side of the descaling apparatus to be within a range of from about 1000° C. to about 1020° C.; and finish rolling the descaled sheet bar.

19. The method according to claim 18, wherein said re-heating step comprises:

adjusting a heating position of the sheet bar such that a surface temperature of the sheet bar before the finish rolling mill is lower than a temperature in a thicknesswise center of the sheet bar.

* * * * *